US005172993A

United States Patent [19]

Ackermann et al.

[11] Patent Number: 5,172,993

[45] Date of Patent: Dec. 22, 1992

[54] LIPSTICK CASE WITH RESILIENT FRICTION TAB

[75] Inventors: Walter T. Ackermann, Watertown; Thomas F. Holloway, Southbury, both of Conn.

[73] Assignee: Risdon Corporation, Naugatuck, Conn.

[21] Appl. No.: 833,053

[22] Filed: Feb. 10, 1992

[51] Int. Cl.[5] ..... A45D 40/06; A45D 40/12

[52] U.S. Cl. ..... 401/69; 401/78; 401/80

[58] Field of Search ..... 401/69, 78, 80, 74

[56] References Cited

U.S. PATENT DOCUMENTS 3,515,493 6/1970 Gruska ..... 401/78 X
3,529,266 11/1970 Hultgren ..... 401/78

FOREIGN PATENT DOCUMENTS 2053268 5/1972 Fed. Rep. of Germany ..... 401/78
2629316 1/1978 Fed. Rep. of Germany ..... 401/78
3316573 11/1984 Fed. Rep. of Germany ..... 401/69
2197295 5/1988 United Kingdom ..... 401/69

*Primary Examiner*—Steven A. Bratlie
*Attorney, Agent, or Firm*—Dallett Hoopes

[57] ABSTRACT

A cosmetic container comprising a tubular base having an internally threaded lower section and an internally smooth upper section mates with a tubular rotatable sleeve extending up from the base. A tubular telescoping screw assembly has one part secured to the base and one part secured to a pomade cup keyed for rotation with the sleeve. A downward tab is formed integrally with the sleeve and has an outward nib on its lower end which presses against the smooth inner surface of the upper section of the base. The nib exerts a frictional drag on the rotation of the sleeve with respect to the base to give the operation of the container a silky "feel".

3 Claims, 1 Drawing Sheet

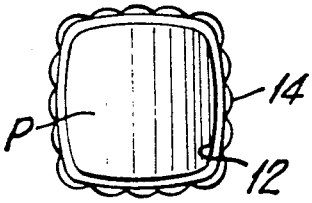
FIG.2
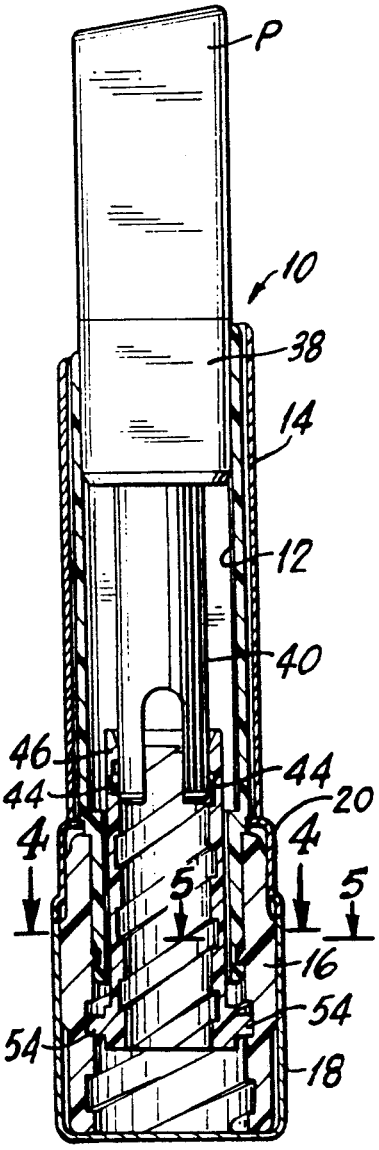
FIG.1
FIG.3
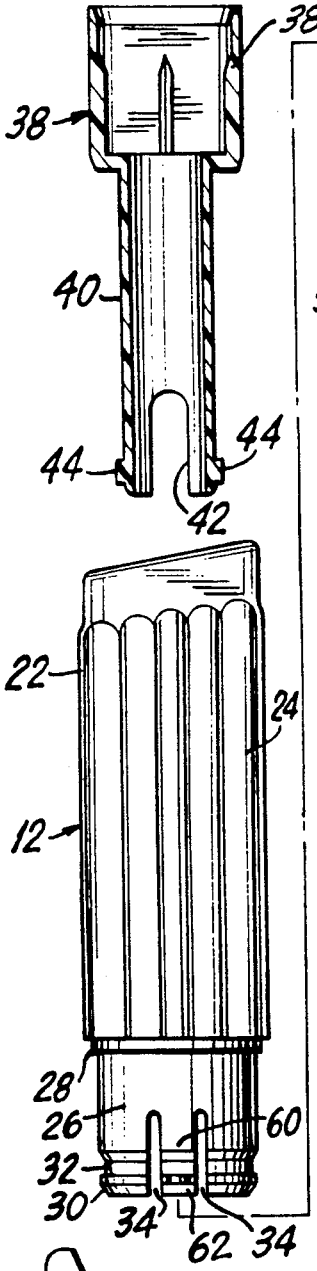
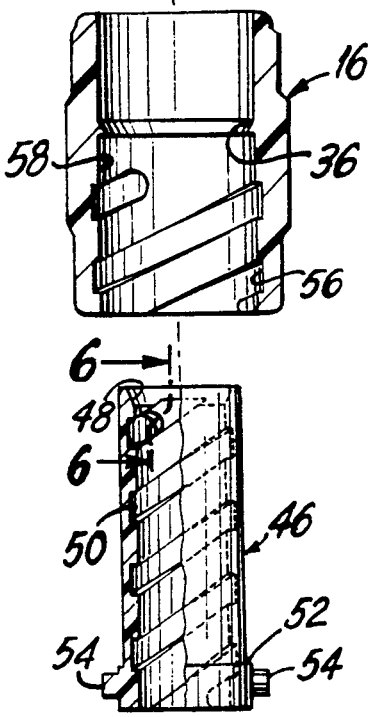
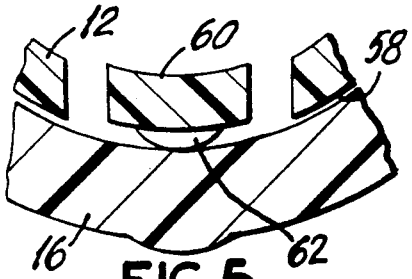
FIG.5
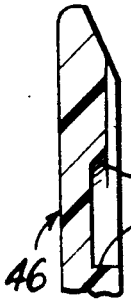
FIG.6
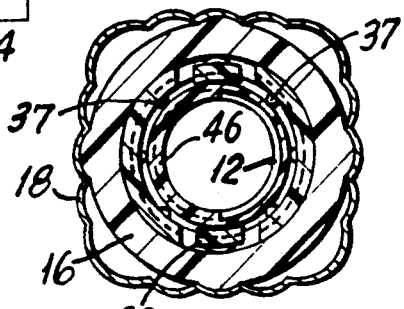
FIG.4

LIPSTICK CASE WITH RESILIENT FRICTION TAB

BACKGROUND OF THE INVENTION

1. Field of the Invention

This invention relates to a lipstick container of the propel-repel type. More specifically, this invention relates to a lipstick container in which the drive mechanism is located entirely in the base beneath the pomade and special means are provided for giving the drive a silky "feel".

2. Description of Related Art including Information Disclosed under §§1.97 to 1.99

The prior art is loaded with patents disclosing details of propel-repel lipstick containers. A number of these references specifically deal with the category of propel-repel lipstick containers in which the drive screw mechanism is located entirely in the base of the lipstick making possible a more slender lipstick package because the upper portion of the container need be only slightly larger than the pomade itself: the pomade cup is not surrounded by the usual cam and slotted sleeve which ordinarily increase the diameter of lipstick containers.

The Applicant is aware of the following patents, all of which deal with propel-repel lipsticks in which the drive, located in the base of the container, comprises telescoping screw elements entirely in the base as stated:

U.S. Pat. No. 2,546,195 which issued Mar. 27, 1951 to C. W. Mellette;

German application DE 3316-573 on an invention by Peter Keller, published on Nov. 8, 1984;

UK patent application 2,197,295 published May 18, 1988 on an invention by Ottavio Terruzzi; and U.S. Pat. No. 4,770,556 which issued Sep. 13, 1988 on an invention by Walter Ackermann and David Ramonas.

The use of the telescoping double screw arrangement as disclosed in the above patents, while meritorious, does have one perceptible defect: the user, as she propels the pomade up or down within the container, "feels" a change in torque as the drive shifts from driving the wider outer screw to driving the narrower inner screw, and vice versa. This "shift" gives a perceptible unevenness to the rotation of the lipstick drive and is undesirable in a quality lipstick.

The present invention is concerned with means to impose a friction on the rotation of the drive mechanism so that the above-described unevenness is no longer perceptible but is masked by the heavier torque required to overcome the friction means.

SUMMARY OF THE INVENTION

In a cosmetic container comprising a tubular base having an internally threaded lower section and an internally smooth upper section and a tubular sleeve containing a pomade cup and rotatably mounted in the base and tubular telescoping screw drive means linking the cup and base, the invention is the improvement of a downward tab formed integrally with the sleeve and having an outward nib on its lower end pressing against the smooth inner surface of the upper section of the base. The nib thereby asserts a frictional drag on the rotation of the sleeve with respect to the base to give the operation of the container a silky "feel".

BRIEF DESCRIPTION OF THE DRAWINGS

Other features and objects of the invention will be apparent from a study of the following specification, including the drawings, all of which show a non-limiting embodiment of the invention. In the drawings:

FIG. 1 is a slightly enlarged sectional view longitudinally of the container and showing the drive means in the base;

FIG. 2 is a top plan view of the container;

FIG. 3 is a slightly enlarged exploded view showing parts partially in section, the outer shell and the base cup and collar not being included;

FIG. 4 is a sectional view taken on the line 4—4 of FIG. 1;

FIG. 5 is a greatly enlarged view showing the operation of the friction tab on the sleeve against the smooth inner surface of the base insert; and FIG. 6 is an enlarged sectional view taken on the line 6—6 of FIG. 3.

DESCRIPTION OF THE PREFERRED EMBODIMENT

The container embodying the invention is generally designated 10 in FIG. 1. It comprises a sleeve 12 preferably of molded plastic and having a decorative metal shell 14 closely surrounding its upper portion. A plastic tubular base insert 16 is provided snugly surrounded by a generally square decorative metal cup 18 (FIG. 4) at its lower portion and a stepped collar 20 also generally square and having a circular opening for sleeve 12 in its top surface.

As shown best in FIG. 3, the plastic sleeve 12 has an upper portion 22 generally squared in cross section for a benefit (which will appear) and is provided with longitudinal flutings 24 which closely complement similar flutings in the shell 14 so that the shell may be effectively cemented onto the sleeve to produce an integral element.

The lower end 26 of the sleeve (FIG. 3) is stepped inward at a shoulder 28 to provide a cylindrical bearing adapted to fit rotatably into the insert 16. As shown, the bottom of the lower portion 26 is formed with a lead-in bevel 30 and above that a circumferential groove 32. It is also longitudinally slotted at spaced points 34. The interior of the base insert is provided with an annular inward rib 36 which may be beveled on its upper face. Inward spacing and bearing pimples 37 are formed (FIG. 4) in the lower end 26 of the sleeve 12.

It can be readily seen that in a part of the assembly the lower end 26 of the sleeve 12, is inserted into the base insert 165 until the lower end 30 snaps past the rib 36 to secure the base insert and sleeve together as a rotatable assembly. At this point the base insert 16 is pressed into the decorative cup 18 and the stepped collar 20 is brought down over the top of the insert until its lower edge engages the cup 18 in smooth alignment.

The internal mechanism will now be described. It includes a molded plastic carrier 38, comprising a cup **38*a* into which the pomade P (FIG. 1) fits in the usual manner. The cup 38*a* is generally square in cross section so that it keys in rotation with the sleeve 12 once it is inside the sleeve (FIG. 1). The relative shapes of these parts are shown in FIG. 2. The carrier 38 is provided with a tubular downward stem 40 which is bifurcated at its lower end 42. The bifurcations are laterally springy and are provided with outward lugs 44**.

Also provided in the mechanism is a tubular cam 46 (FIG. 3). The cam is preferably provided with a lead-in bevel 48 and internal right-hand threads 50. The lower end of the cam 46 is provided with an annular enlargement 52 which is formed with diametrically opposed outward lugs 54.

The base insert 16 is similarly provided with internal right-hand threads 56. Between the upper end of the threads 56 and the annular inward rib 36 the insert 16 is formed with a smooth inner circumference as at 58.

In assembly, as suggested in FIG. 3, the base insert is lined up under the cylindrical lower end 26 of the sleeve. The sleeve is then brought downward until the lower end thereof snaps past the rib 36 and the rib is installed in the groove 32 to rotatably connect the two parts. Next, the cam 46 is poked upward into the lower end of the sleeve 12, and turned so that the lugs 54 engage the threads 56 on base insert 16.

From above, the pomade-loaded carrier 38 is moved downward so that its stem 40 lines up with the cam 46 and the lugs 44 on stem 40 are pinched inward by the lead-in 48. The carrier 38 is moved downward in assembly so that the lugs 44 snap into the threads 50 on the cam 46. The final step in the assembly is to install the square cup 18 on the lower end of the base insert 16.

Attention is now directed to an essential of the present invention, namely the means for applying friction to the operation of the lipstick. As shown best in FIGS. 3, 4 and 5, a pair of spaced slots 34, as described, in the bottom of sleeve 12 define a downward tab 60. A similar tab (not shown) may be disposed on the opposite side of the sleeve 12. The tab is formed with an enlarged outward nib 62 which may be dome-shaped (FIG. 5).

After assembly the nib 62 is forceably disposed against the smooth section 58 of the base insert so that as the sleeve 12 and the insert 16 move relatively, the nib rubs on the zone 58, causing constant increased torque. As described, there may be a pair of tabs 60 on diametrically opposite sides of the sleeve, each having an outward nib 62.

Aside from the imposed friction-enhancing character of the nib 62, the operation of the present container is similar to those in the patents referenced above.

As the base is turned clockwise (as seen from below) and the sleeve 12 held stationary, the threads 56 drive upward the lugs 54 until they reach the upper end of the thread 56. Thereafter the cam 46, now rotating with the base, moves upward, the lugs 44 now already raised with the cam to the upper end of the threads 56 in the cam. Obviously, raising the lugs 44 raises the entire carrier, including the cup 38*a* with the pomade P.

It may be because of friction or various differences in thread design that the rotation of the base will cause the cam 46 to raise before the carrier. At any rate, whichever element moves first, it moves for a while and then the other element moves. In the past this has caused a perceptible change in torque as the base is turned relative to the sleeve. This difference is no longer palpable under the present invention: a steady friction is felt and a constant torque is required during the raising process. As in raising the carrier, all of the above is true in lowering the carrier by the counter-clockwise (viewed upward from the bottom) rotation of the base with respect to the sleeve.

FIG. 6 is a sectional view showing the contour at the upper end of the thread 50. The end of the thread is provided with an incline 64. As a result, it is possible for the lugs 44 to ride up the incline if the torque between sleeve and base is increased (that is, the sleeve is turned harder) after the cup reaches its normal extended position. This is possible because, as shown best in FIGS. 1 and 3, the bifurcations at the lower end 42 of the stem 40 can flex inward. It will be clear that once the lugs 44 have been driven up the incline 64, the cup and its contents are then free to be picked up out of the container.

Variations in the invention are possible without departing from the spirit of the invention. Thus, while the invention has been shown in only one embodiment, it is not so limited but is of a scope defined by the following claim language which may be broadened by an extension of the right to exclude others from making or using the invention as is appropriate under the doctrine of equivalents.

What is claimed is:

1. A cosmetic container comprising:

(a) a tubular base having an internally threaded lower section and an internally smooth upper section and retaining means about the inside of the upper section, (b) a tubular sleeve having a reduced lower section rotatably disposed in the upper section of the base and a shoulder above the reduced lower section riding on the top of the base and a cooperant means on the reduced section engaging the retaining means to hold the sleeve and base together, a downward tab formed integrally with the reduced lower section of the sleeve and an outward nib on the lower end of the tab pressing against the smooth inner surface of the upper section of the base, (c) a tubular cam having an internal thread of the same hand as the thread of the base and an outward lug adjacent the lower end thereof disposed in the thread in the base, the upper end of the internal threads in the tubular cam being formed with an incline up to the inside surface of the tubular cam, (d) a cup formed with a central downward stem having an outward lug at the lower end thereof disposed in the thread in the cam, the cup riding vertically in the sleeve, (e) means holding the sup and the sleeve against relative rotation, whereby the nib exerts a frictional drag on the rotation of the sleeve with respect to the base and the lugs in the stem can be smoothly driven up the incline to liberate the stem from the cam, all to give the operation of the container a silky "feel".

2. A cosmetic container as claimed in claim 1 wherein the means holding the cup and sleeve against rotation is similar non-circular peripheral shapes of the outside of the cup and the inside of the sleeve.

3. A cosmetic container as claimed in claim 1 wherein the reduced lower section of the sleeve is slotted longitudinally from its lower end upward in peripherally spaced slots to define the downward tab and the nib is disposed outward adjacent the lower end of the tab.

* * * * *